US009579888B2

(12) United States Patent
Kudo et al.

(10) Patent No.: US 9,579,888 B2
(45) Date of Patent: Feb. 28, 2017

(54) RECORDING ELEMENT SUBSTRATE

(75) Inventors: Tomoko Kudo, Kawasaki (JP); Tatsuo Furukawa, Zama (JP); Nobuyuki Hirayama, Fujisawa (JP); Ryo Kasai, Tokyo (JP); Kimiyuki Hayasaki, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 616 days.

(21) Appl. No.: 12/965,744

(22) Filed: Dec. 10, 2010

(65) Prior Publication Data

US 2011/0279511 A1 Nov. 17, 2011

(30) Foreign Application Priority Data

May 14, 2010 (JP) ..... 2010-112368

(51) Int. Cl.
*B41J 2/05* (2006.01)
*B41J 2/045* (2006.01)

(52) U.S. Cl.
CPC ..... *B41J 2/0458* (2013.01); *B41J 2/0455* (2013.01); *B41J 2/04541* (2013.01)

(58) Field of Classification Search
USPC ..... 347/50, 59
See application file for complete search history.

(56) References Cited

U.S. PATENT DOCUMENTS 6,293,655 B1 * 9/2001 Imanaka et al. ..... 347/65
7,133,153 B2 * 11/2006 Furukawa ..... B41J 2/0452 347/17
2006/0125871 A1 * 6/2006 Furukawa ..... 347/20
2006/0139412 A1 * 6/2006 Sakurai et al. ..... 347/61
2007/0296743 A1 12/2007 Sakurai
2009/0160892 A1 6/2009 Hayasaki

FOREIGN PATENT DOCUMENTS

JP 08-309974 A 11/1996
JP 2002-321367 A 11/2002
JP 2003-226012 A 8/2003
JP 2006-159783 A 6/2006
JP 2008-23990 A 2/2008
JP 2009-149035 A 7/2009
JP 2009-149036 A 7/2009
JP 2009-298031 A 12/2009

* cited by examiner

*Primary Examiner* — Chad Smith

(74) *Attorney, Agent, or Firm* — Canon USA, Inc. IP Division

(57) ABSTRACT

A substrate includes a first and a second element arrays in each of which a plurality of elements is arrayed along a first direction of the substrate, a first and a second pad arrays in which a plurality of pads is arrayed along respective two opposite sides extending along a second direction of the substrate, a reception circuit configured to receive data for driving the elements, a data circuit configured to generate data corresponding to the first and the second element array, respectively based on the received data, a signal generation circuit configured to generate a period signal for determining a drive period of the elements based on the generated data, and an output circuit configured to output information related to the substrate.

22 Claims, 10 Drawing Sheets

RECORDING ELEMENT SUBSTRATE

BACKGROUND OF THE INVENTION

Field of the Invention

The present invention relates to a recording element substrate that includes a circuit that receives data and controls the driving of recording elements based on the data.

Description of the Related Art

Japanese Patent Application Laid-Open No. 2008-23990 discusses a recording element substrate that is provided with a plurality of recording element arrays and driving circuits that correspond to the recording element arrays. Japanese Patent Application Laid-Open No. 2009-149036 discusses the reception of data by a recording head in the form of a low voltage differential signal (LVDS), and the production of a signal for controlling the driving of the recording elements.

The number of signals or the amount of data for controlling the driving of the recording elements is increased by an increase in the number of recording element arrays provided in the recording element substrate. Furthermore, the development of multifunction recording element substrates has created a demand for acquisition and control of information related to the recording element substrate. Consequently high-frequency applications are developing in relation to signals flowing through the circuits in the recording element substrate. As a result, problems have arisen that are associated with restrictions on the disposition of the circuits on the recording element substrate and the increase in the surface area of the recording element substrate. Japanese Patent Application Laid-Open No. 2008-23990 and Japanese Patent Application Laid-Open No. 2009-149036 do not include specific teaching in relation to the disposition of circuits on the recording element substrate according to this problem.

SUMMARY OF THE INVENTION

According to an aspect of the present invention, a substrate of rectangular shape includes a first and a second element arrays in each of which a plurality of elements is arrayed along a first direction of the substrate, a first and a second pad arrays in which a plurality of pads is arrayed along respective two opposite sides extending along a second direction of the substrate, a reception circuit configured to receive data for driving the elements, a data generation circuit configured to generate data corresponding to the first and the second recording element arrays respectively based on the received data, a signal generation circuit configured to generate a period signal for determining a drive period of the elements based on the generated data, and an output circuit configured to output information related to the substrate, wherein the signal generation circuit, the reception circuit, and the data generation circuit are disposed between the first and second recording element arrays and the first pad array, and the output circuit is disposed between the first and second recording element arrays and the second pad array.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
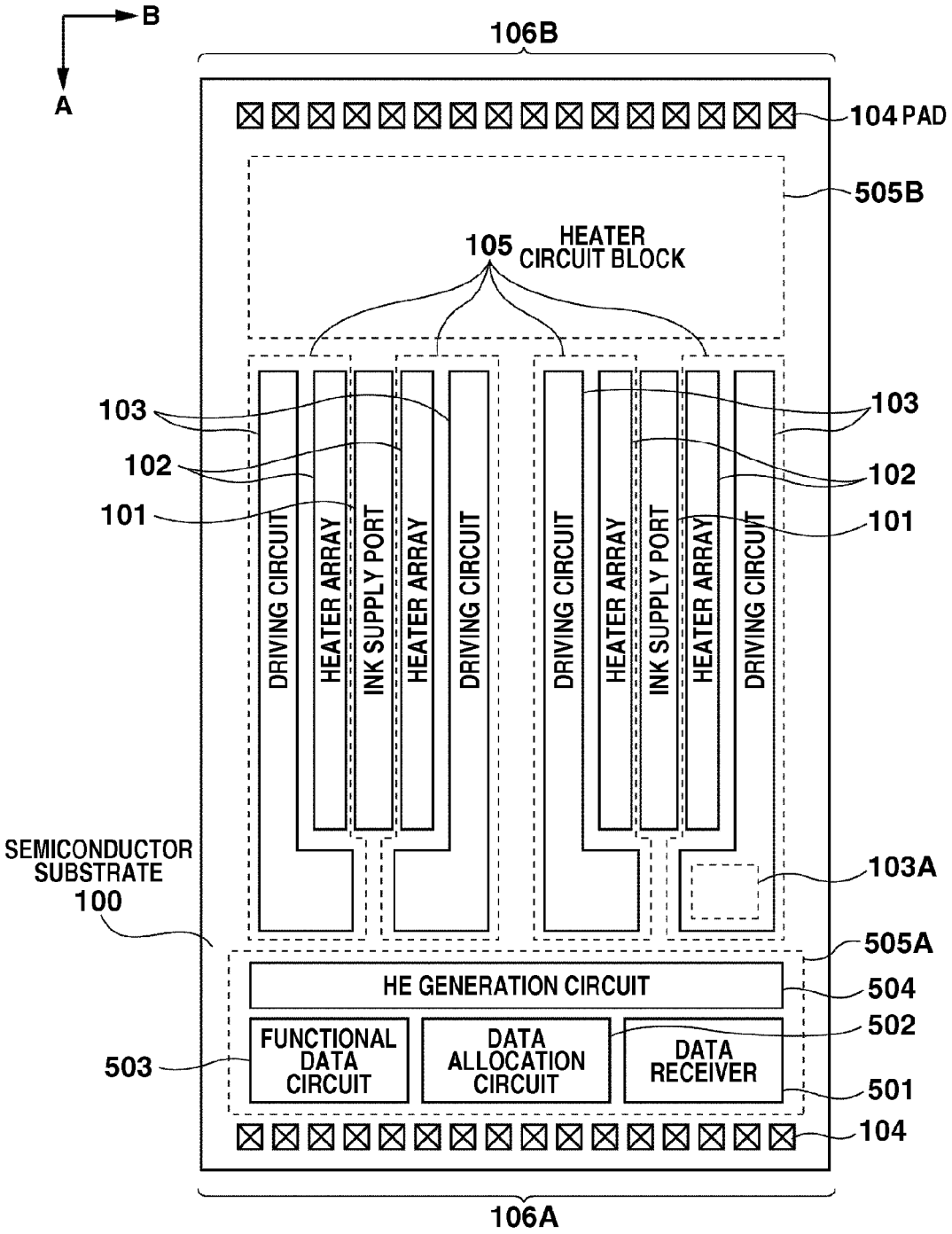
FIG. 1 illustrates the circuit layout of a recording element substrate according to a first exemplary embodiment of the present invention.

FIG. 1 illustrates the circuit layout of a recording element substrate according to a first exemplary embodiment of the present invention. A semiconductor substrate (recording element substrate) 100 of rectangular shape as illustrated in FIG. 1 includes two ink supply ports 101. The semiconductor substrate (recording element substrate) 100 includes four heater circuit blocks 105. The heater circuit blocks 105 include a heater array 102 and a drive circuit 103, and are disposed opposite each other across the ink supply port 101. The heater array (recording element array) 102 includes a plurality of heaters arrayed in the direction of arrow A (first direction). The drive circuit 103 driving the heater is disposed facing the heater. Ink is discharged by driving the heater.

The drive circuit 103 is divided into a plurality of groups at each of a predetermined number of heaters (each recording element) that are adjacent in the heater array (in the recording element array). The heaters that belong to each group are driven in a predetermined order for a predetermined period. The heaters that belong to each group are driven at different timing for a predetermined period. More specifically, the heaters belonging to a group are assigned to different blocks and driven at the time division for each block. A time-division control circuit (timing control circuit) is provided in a region 103A.

A pad array (first pad array) 106A and a pad array (second pad array) 106B respectively include a plurality of pads 104 arrayed in the direction of arrow B (second direction). In FIG. 1, the pad array 106A and the pad array 106B are respectively disposed in the semiconductor substrate (recording element substrate) 100. These pads are used to input signals, output signals, and input a power source.

The region 505A includes a data receiver (reception circuit) 501, a data allocation circuit (data generation circuit) 502, a functional data circuit 503, a heat enable (HE) generation circuit (signal generation circuit) 504, and the like. The functional data circuit 503 includes a circuit that acquires information for selection of a temperature detection element, and a determination circuit that determines parity to detect a reception error for data received from the outside of the recording element substrate 100.

The region 505B includes a determination circuit that determines parity to detect a transfer error for data transferred in the recording element substrate 100. The region 505B further includes an output circuit or the like that outputs information detected by the temperature detection element and the selection circuit of the temperature detection element.

In the first exemplary embodiment, reception of data and signals is performed by differential signaling. The data receiver (reception circuit) 501 includes a circuit for receiving LVDS (low voltage differential signals). The data allocation circuit (data generation circuit) 502 generates data corresponding to the heater array 102 from data received by the data receiver (reception circuit) 501. In FIG. 1, since four heater arrays are provided, data is generated for four arrays. The functional data circuit 503 is a circuit that processes data for a data transfer error detection circuit or a temperature detection element selection circuit.

The data receiver 501 is a circuit that collects the signals sent at two different voltages to a single signal. Furthermore, the data receiver 501 may also have a configuration including respective CLK, DATA1 systems, or a configuration including a plurality of channels.

Figure 4:
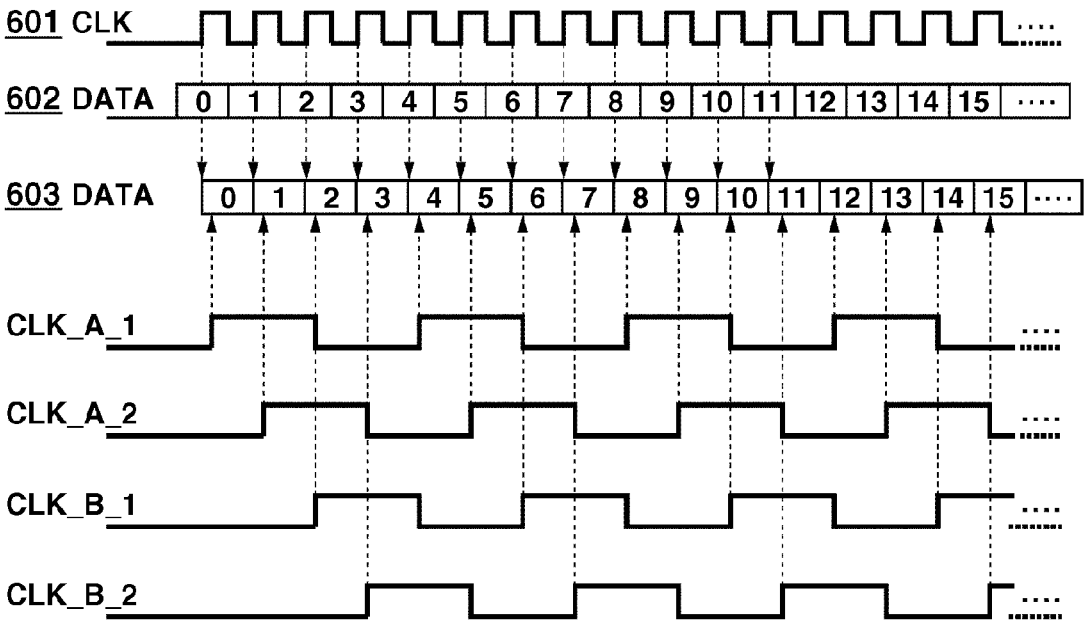
FIG. 4 is a diagram of clock signals generated by a clock (CLK) frequency dividing circuit according to the first exemplary embodiment.

Next, the signal received by the data receiver 501 is sent to the data allocation circuit 502. The data allocation circuit 502 includes a shift register and a clock frequency dividing circuit. Data (DATA) is transferred in synchronization with the clock (CLK) by the shift register to generate a plurality of frequency-divided clock signals (3 channels in ¼ frequency division) that are adjusted to a low frequency by the CLK frequency dividing circuit. FIG. 4 illustrates the timing of generating clock signals. A CLK signal 601 that is input to the substrate, DATA 602, and an output 603 that is generated based on the DATA 602 in synchronization with the CLK 601 with the shift register of the data allocation circuit 502 are provided. A CLK signal 604 is ¼ frequency divided by the CLK frequency dividing circuit. The DATA 603 is read at a rising edge of CLK_A_1-CLK_B_2, and is allocated to the four data lines. The four allocated pieces of data are input to the respective shift registers.

The functional data circuit 503 performs data processing to control the circuit provided in the region 505B. In this manner, there is no requirement to provide an element in each circuit provided in the region 505B, and it is possible to reduce the number of terminals on the element substrate. The element substrate has the function of confirming the erroneous reception of data or the erroneous transmission of data during high-speed transfer. In addition, the element substrate has the function of switching the switch with a plurality of individual temperature detection elements to detect the temperature distribution in the element substrate, and reading the output of the plurality of elements. Furthermore, the element substrate has the function of determining the parity check bit for confirming receipt of data. For this purpose, the functional data circuit 503 includes a shift register and a latch circuit.

Figure 2:
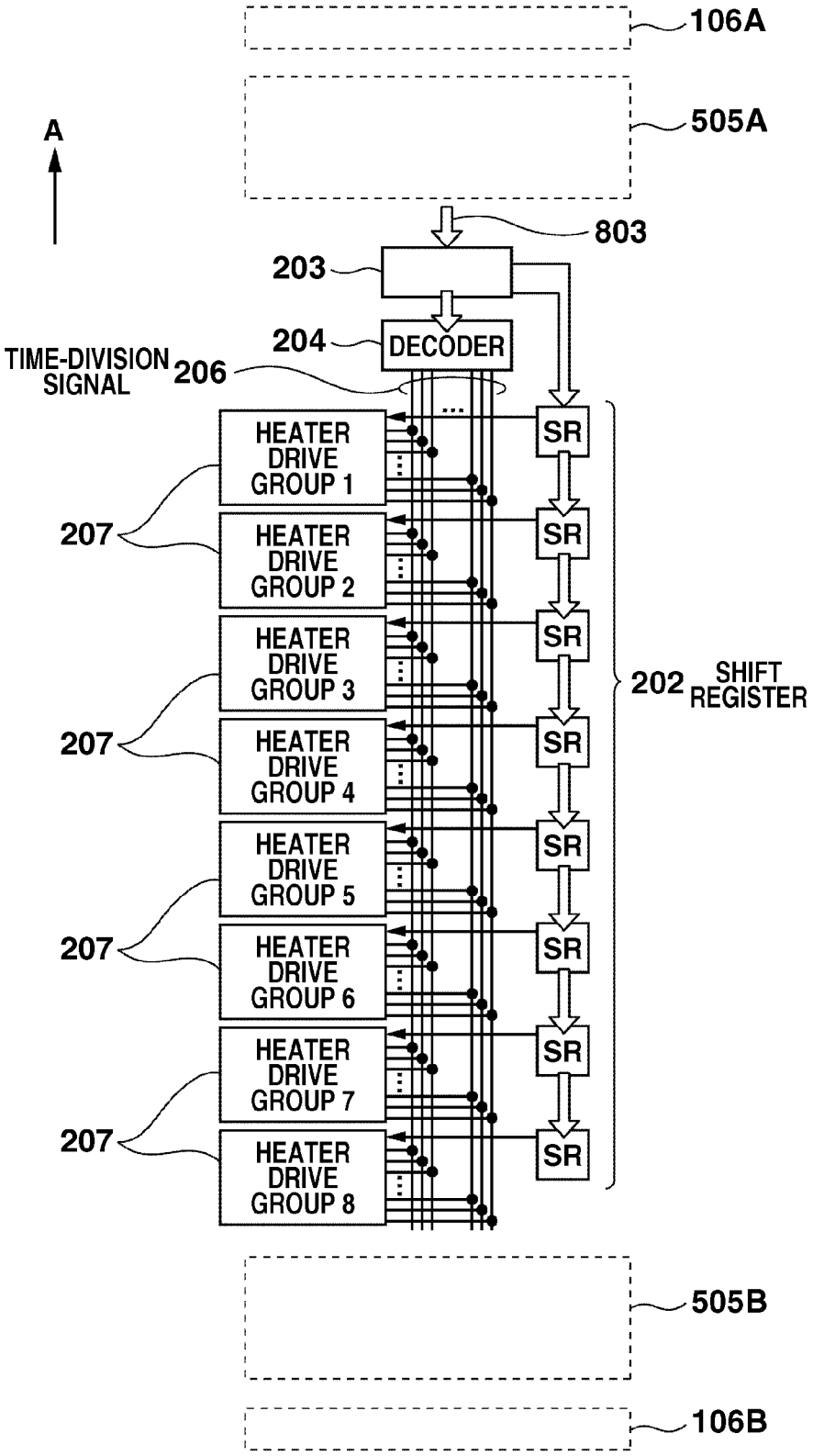
FIG. 2 illustrates an inner portion of a drive circuit according to the first exemplary embodiment.

FIG. 2 illustrates the drive circuit 103. For the sake of simplicity, one drive circuit will be described. The drive circuit 103 includes eight heater drive groups 207. There are 16 heaters in each heater drive group 207. Element selection data 803 input to the drive circuit 103 is transferred in sequence through a shift register 203 and shift registers 202. Time-division control data (time-division information) in the element selection data 803 is input to a decoder 204 through the shift register 203. The decoder 204 outputs time-division signals 206, and the heater drive group 207 inputs the respective signals. Each group includes a shift register 202. The heater drive group 207 inputs a recording data signal from the shift register 202. By inputting this signal, each heater drive group 207 selects the recording element to be driven and performs driving based on the recording data signal. When the number of heaters contained in each group is 16, the number of signal lines for the time-division signals (timing control signals) is 16, and there are four bits of time-division control data (time-division information). When this configuration is generalized, $2^n$ heaters contained in a group corresponds to $2^n$ signal lines for the time-division signals, and n bits of time-division control data (timing control information).

Figure 3:
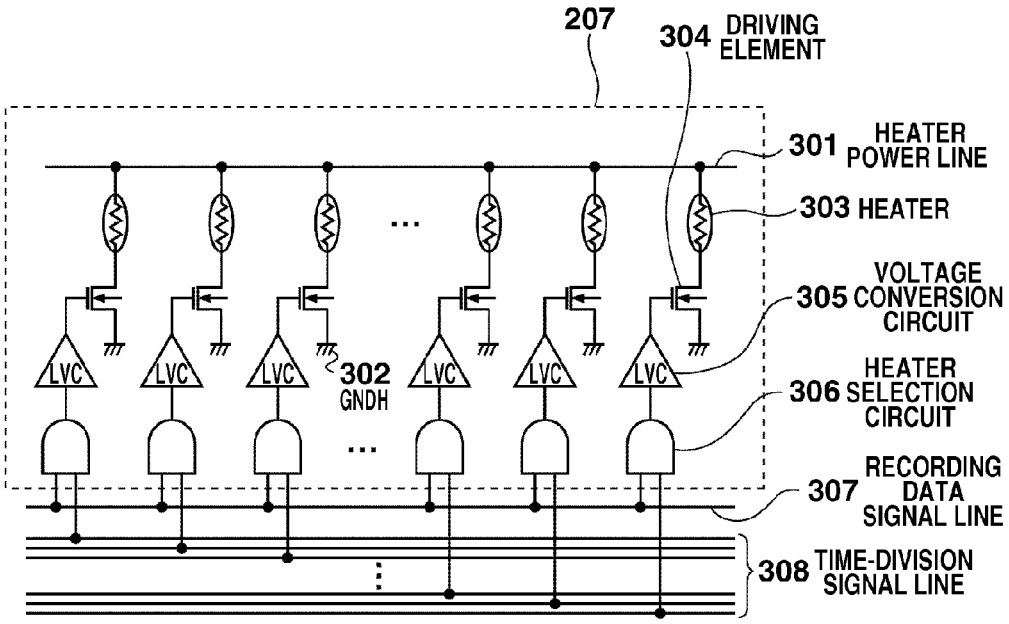
FIG. 3 illustrates the circuit configuration in a heater group according to the first exemplary embodiment.

FIG. 3 illustrates the configuration of the heater drive group 207. The heater drive group 207 includes heaters 303, drive elements (MOS transistors) 304, voltage conversion circuits 305, and heater selection circuits 306. There are 16 heaters 303 provided in each heater drive group 207.

The heater power line 301 is supplied with a drive voltage for heaters supplied from an external unit (first voltage: for example 24 volts). When the drive element 304 for the heater 303 is turned ON, a current flows to the ground (GNDH) 302. The drive element 304 is a switch for determining whether a current is applied to the heater 303. The recording data signal line 307 and the time-division signal line 308 are connected to the input of an AND gate which functions as the heater selection circuit 306. When these two signals are both active, the output of the AND gate becomes active. The voltage conversion circuit 305 increases the voltage amplification of the signal. The output signal of the AND gate 306 is increased from a logic voltage (third voltage: for example, 5 volts) to a second voltage (for example, 12 volts) by the voltage conversion circuit 305. With the input circuit to the heater selection circuit 305, the voltage is converted to the level of the power-source voltage (second voltage) that is higher than the drive voltage (third voltage). The output of the voltage conversion circuit 305 is connected to the gate of the drive element 304.

Referring back to FIG. 1, the HE generation circuit (signal generation circuit) 504 is a circuit that generates a period signal (HE signal) that determines the drive period of the heater (recording element). For example, data having the value of the start timing and end timing of the HE signal is input, the value is counted by respective counters, and the output signals are combined to generate an HE signal. In FIG. 1, four heater arrays are provided. The HE generation circuit 504 generates a first period signal to a fourth period signal corresponding to the heater arrays. The HE generation circuit 504 includes a number of counters corresponding to the start (rising) and end (fall) of the HE signals. The HE generation circuit includes a shift register and a latch circuit for receiving data.

Figure 6:
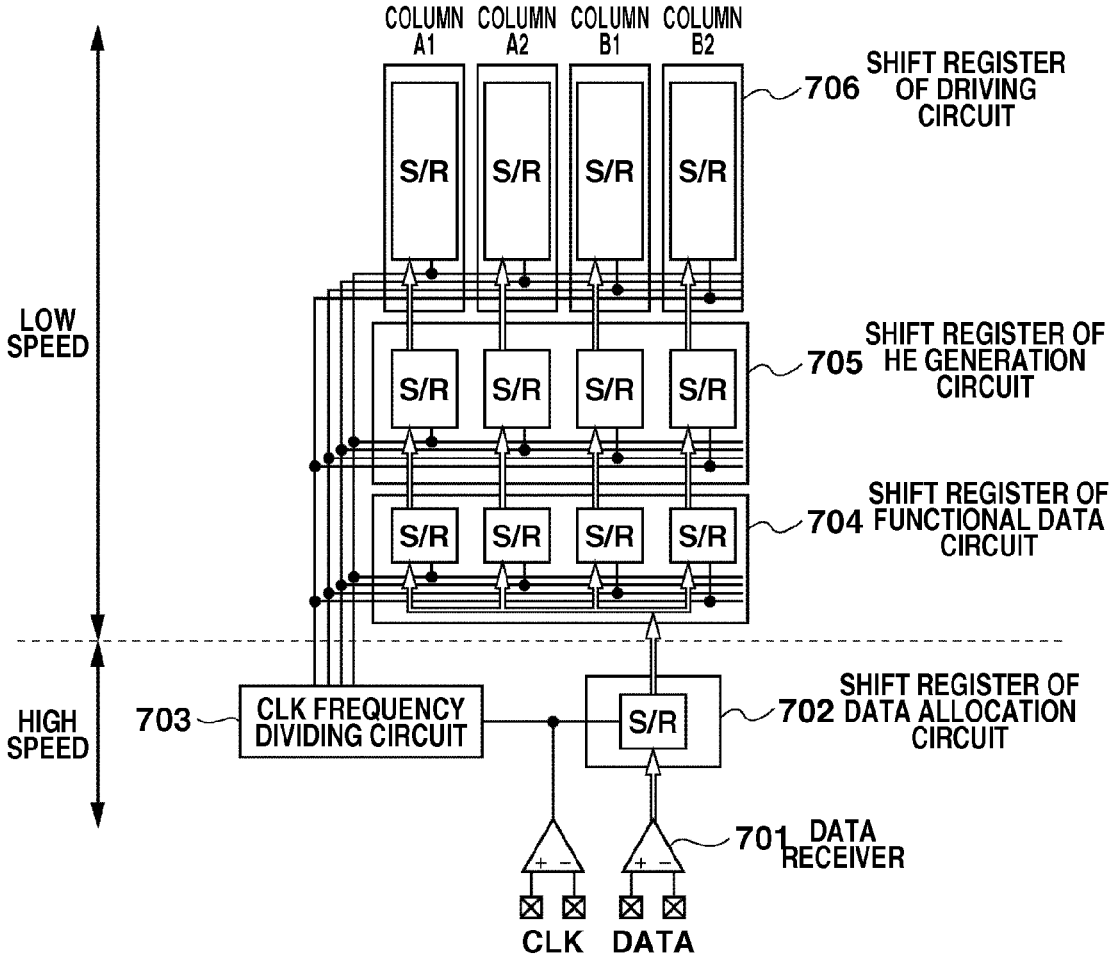
FIG. 6 illustrates the order of transferring data in the recording element substrate, which is generated by the data allocation circuit, according to the first exemplary embodiment.

Next, allocation of the data to each recording element array will be described. FIG. 6 illustrates the shift register of each circuit to illustrate the flow of the signal and the speed of the signal. The CLK signal and the DATA signal input to the recording element substrate are received by the data receiver 701, and are sent to the shift register 702 of the data allocation circuit. As illustrated in FIG. 4, a CLK signal that is frequency divided by the CLK frequency dividing circuit 703 is generated. In FIG. 4, ¼ frequency divided clock signals CLK_A_1, CLK_A_2, CLK_B_1, and CLK_B_2 are generated. The data allocation circuit as illustrated in FIG. 4 selects data in a bit-by-bit sequence at the rising edge of each clock signal, and generates the data selected at each clock signal into one data array (data group) corresponding to the clock signal.

Figure 5:
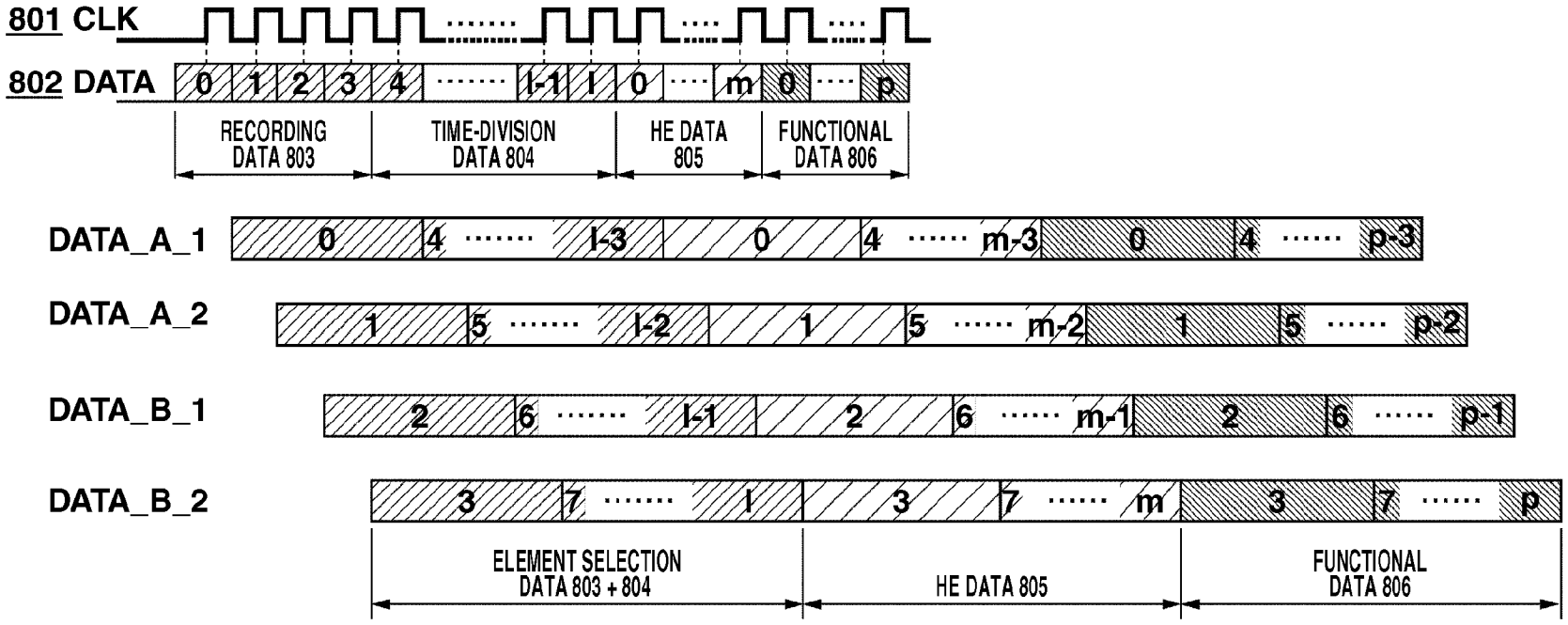
FIG. 5 illustrates data generated by a data allocation circuit according to the first exemplary embodiment.

FIG. 5 illustrates the details of the input data allocated to four channels. The data (DATA) 802 is output from the data allocation circuit. Data DATA_A_1 is selected based on the signal CLK_A_1. Data DATA_A_2 is selected based on the signal CLK_A_2. Data DATA_B_1 is selected based on the signal CLK_B_1. Data DATA_B_2 is selected based on the signal CLK_B_2. FIG. 5 illustrates the details of the timing from the head to four bits (0-3) of the data (DATA) 802. The timing after that is simplified in the illustration of FIG. 5. The data 802 is transferred in sequence from the head, in the order of recording data 803, time-division data (drive timing data) 804, HE data 805, and functional data 806, and is received in that sequence by the data allocation circuit. The recording data 803 and the time-division data 804 are referred to as the element selection data. The data allocation circuit 502 generates and outputs four pieces of data DATA_A_1, DATA_A_2, DATA_B_1, and DATA_B_2, as described above.

The shift register 704 of the functional data circuit can be disposed after the shift register 702 of the data allocation circuit. This is due to the fact that a disposition upstream of data transfer (near to the input port) enables input of a number of CLK signals corresponding to the number of pieces of functional data when inputting only functional data, and after latching, enables reading out of the data. In other words, when inputting only functional data, there is no requirement to transfer unnecessary empty data. Since acquisition of temperature information in functional data is performed at a separate timing from the control period of driving the recording element, it may be the case that only functional data is received. Therefore, since it is possible to transmit the minimum required data, the time required for data transfer control can be shortened.

As described above, the format of the data signal as illustrated in FIG. 5 is determined corresponding to the arrangement of the shift registers illustrated in FIG. 6. The data signal 802 is transferred in sequence in the order of the data receiver 701, the shift register 702 in the data allocation circuit, the shift register 704 in the functional data circuit to the shift register 705 in the HE generation circuit, and the shift register 706 in the drive circuit, as illustrated in FIG. 6.

As illustrated in FIG. 6, the element selection data for driving the heaters is transferred up to the shift register 706, and is, therefore, allocated to the head of the data signal. Then, the HE data 805 to be transmitted to the HE generation circuit 705 follows, and thereafter the functional data 806 to be transmitted to the functional data circuit 704 follows. Although data received by the reception circuit is divided into four channels, the data sequence after division is in the sequence of recording data, time-division data (driving timing data), HE data, and functional data, and is the same before and after division.

The circuit configuration provided on a semiconductor substrate (recording element substrate) 100 as described above can adapt to developments in high functionality of the recording element substrate, and can avoid an increase in the surface area of the recording element substrate.

Figure 7:
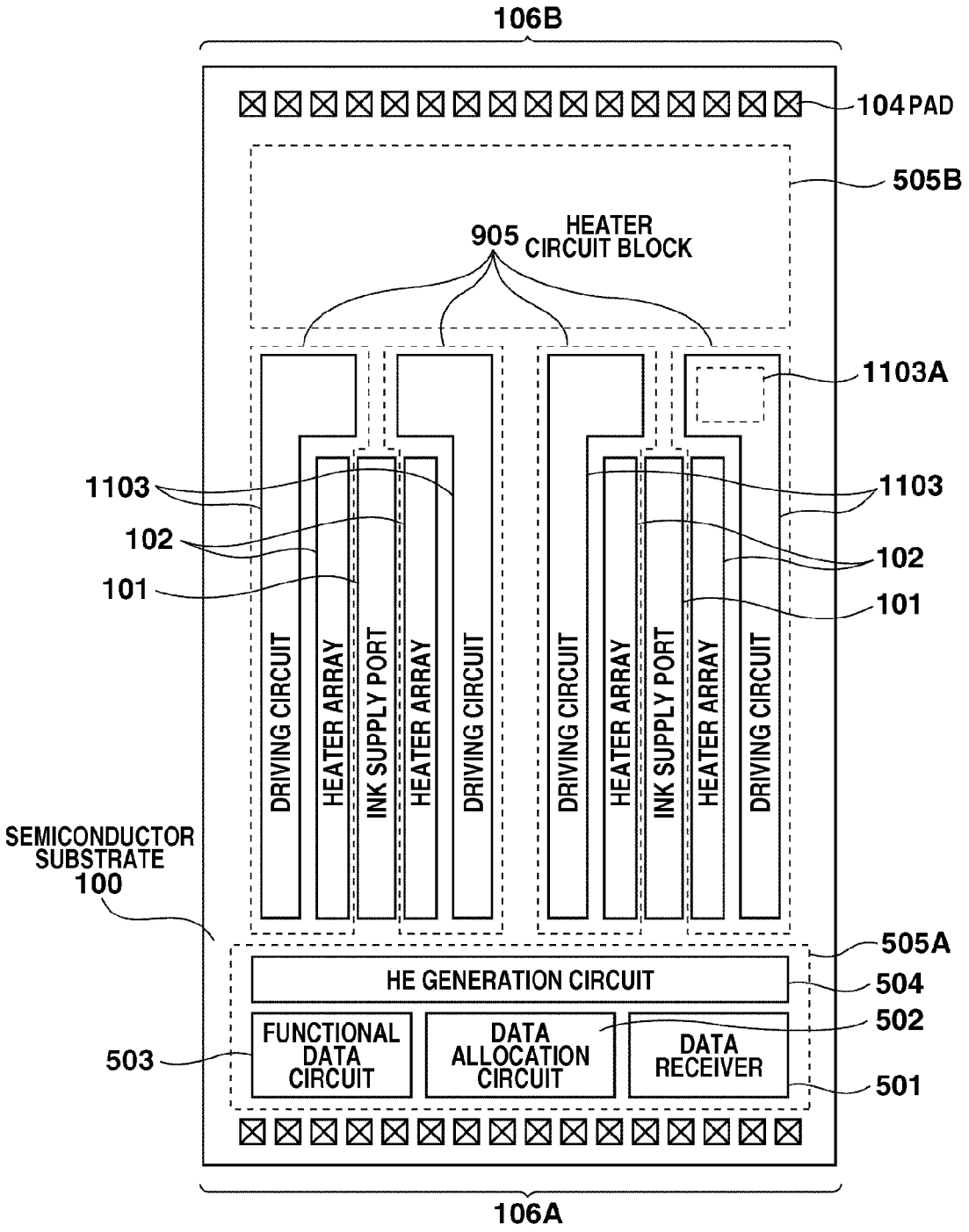
FIG. 7 illustrates the circuit layout of a recording element substrate according to a second exemplary embodiment of the present invention.

FIG. 7 illustrates a recording element substrate according to a second exemplary embodiment of the present invention. The shape of the region of the drive circuit 1103 that is allocated to the recording element substrate is different from the shape of the region described in FIG. 1 according to the first exemplary embodiment. The other details are the same as those illustrated in FIG. 1, and, therefore, those parts of the description will not be repeated.

Figure 8:
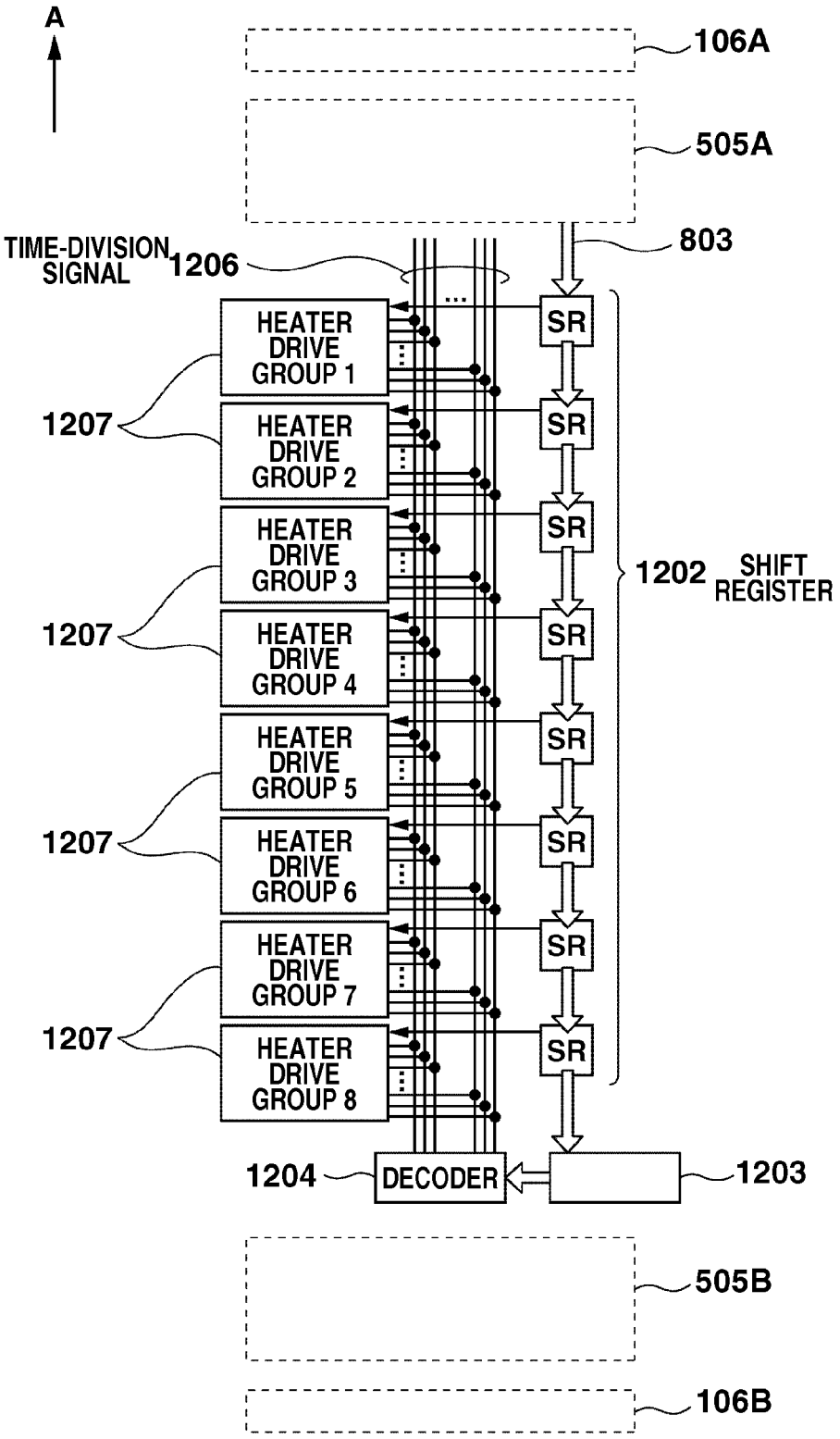
FIG. 8 illustrates an inner portion of a drive circuit according to the second exemplary embodiment.
Figure 9:
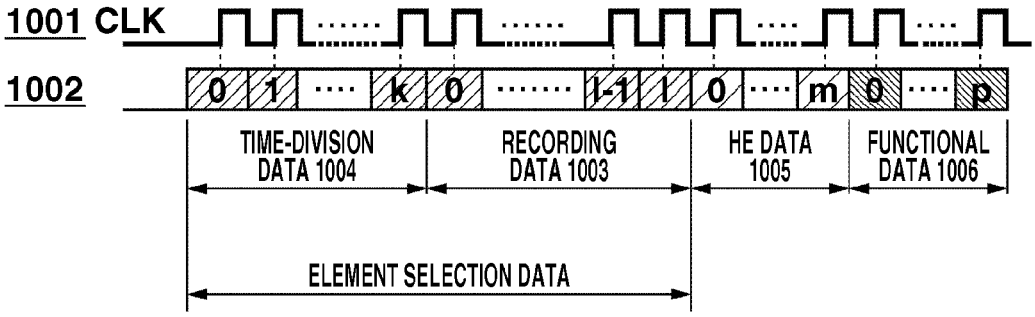
FIG. 9 illustrates data generated by a data allocation circuit according to the second exemplary embodiment.

The shape of the region of the drive circuit 1103 will be described with reference to FIG. 8. FIG. 8 and FIG. 2, which is described with reference to the first embodiment, differ only with respect to the position of the time-division control circuit (timing control circuit). The time-division control circuit is disposed in the region 1103A of the drive circuit 1103 as illustrated in FIG. 7. The time-division control circuit includes a shift register 1203 and a decoder 1204. As a result, when data is transferred in the sequence illustrated in FIG. 9, the head of data is the time-division data (drive timing data) 1004, and the recording data 1003, the HE data 1005, and the functional data 1006 follow in this order. The operation of each circuit is the same as that described with reference to the first exemplary embodiment, and, therefore, description will be not repeated. The time-division control circuit is disposed near to the second pad array (the region 505B) in the heater circuit block 905. In this manner, a space can be ensured in the region 505A near to the first pad array of the recording element substrate.

Figure 10:
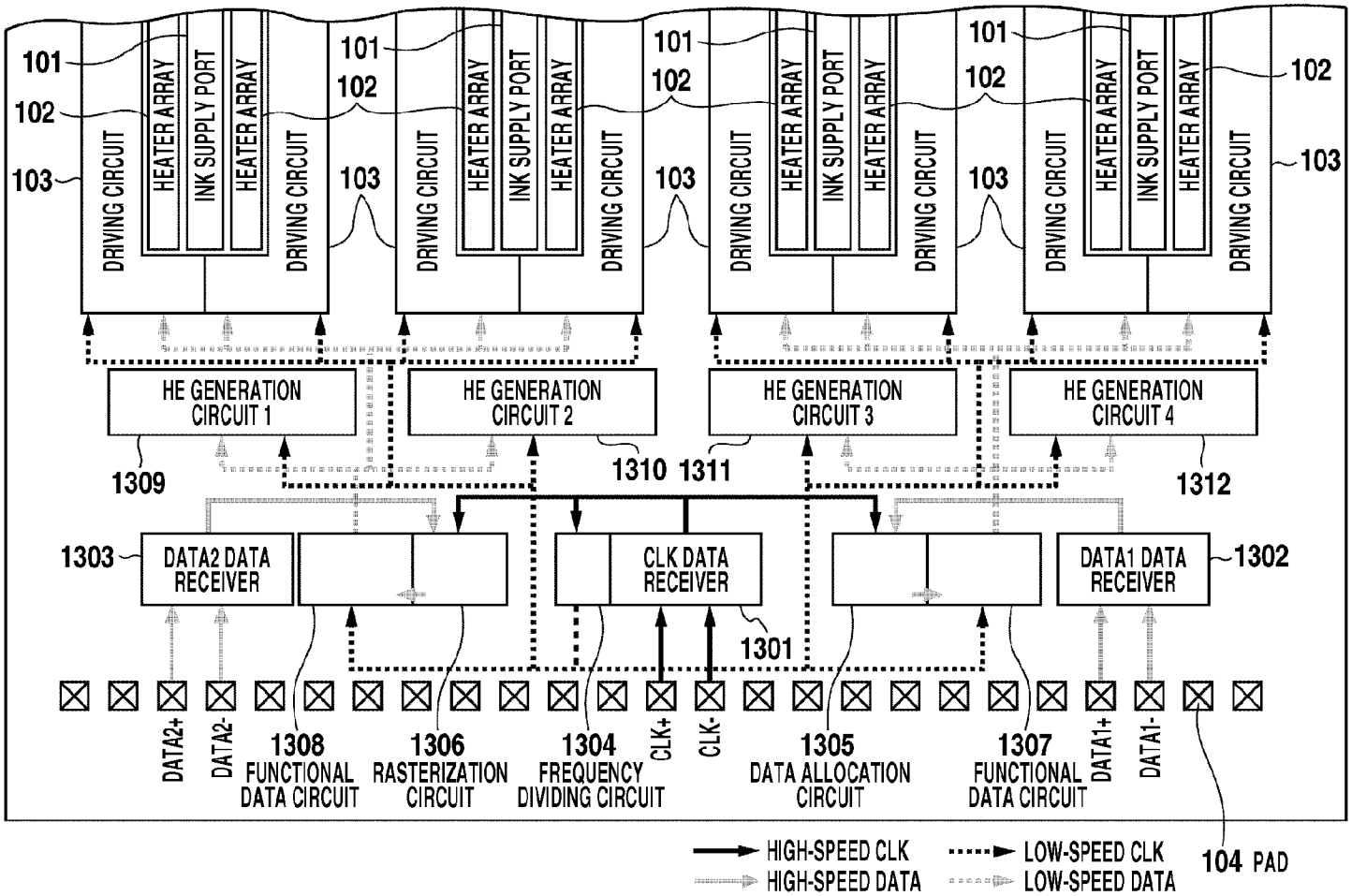
FIG. 10 illustrates a portion of the circuit layout of a recording element substrate according to a third exemplary embodiment of the present invention.

In a third exemplary embodiment of the present invention, as illustrated in FIG. 10, four ink supply ports 101 and eight heater circuit blocks are disposed on the semiconductor substrate (recording element substrate) 100. Accordingly, a data receiver for clock signals is provided as a single channel, and data receivers for data signals are provided as two (a plurality of) channels. In this manner, the disposition of the reception circuit and the number of reception circuits differ from those in the first exemplary embodiment.

FIG. 10 is an enlarged view of the vicinity of the pad array 106A of the recording element substrate. The course of a signal that is input from the pad 104 included in the pad array 106A is indicated by the arrow. A CLK signal receiver 1301 and a frequency dividing circuit 1304 are disposed on an inner side of the recording element substrate with respect to the array direction of the pads 104. A DATA1 signal receiver 1302 and a DATA2 signal receiver 1303 are disposed on an outer side of the recording element substrate. A frequency dividing circuit 1304 executes frequency division of the clock signal to thereby generate a low-speed CLK signal from the high-speed CLK signal. Allocation circuits 1305 and 1306 each include a shift register, which adjusts the timing of the CLK signal and the high-speed DATA signal. Functional data circuits 1307 and 1308 each include a switch for switching recording elements. Four HE generation circuits 1309 to 1312 each generate period signals (HE signals) to be supplied to two heater circuit blocks.

In the third exemplary embodiment, since there are two channels of DATA signals input from the outside of the recording element substrate, a single-channel CLK signal is used to synchronize each allocation circuit. A delay in the CLK signal and DATA signal caused in the transmission pathway up to the substrate is corrected by re-transferring the high-speed CLK and the high-speed DATA in the shift register of the allocation circuit. As illustrated in FIG. 13, high-speed data transfer is executed up to the functional data circuit. Since there is a narrow time window allowing the delay for transfer by high-speed CLK, the disposition of the circuits is configured to reduce a delay in the signals resulting from the transmission pathway. As illustrated in FIG. 13, the CLK signal data receiver 1301 is disposed between the DATA1 signal data receiver 1302 and the DATA2 signal data receiver 1303, and the rasterization circuit 1305 is disposed in the middle of the CLK signal data receiver 1301 and the DATA1 signal data receiver 1302. In the same manner, the allocation circuit 1306 is disposed in the middle of the CLK signal data receiver 1301 and the DATA1 signal data receiver 1303. The functional data circuit is disposed adjacent to the allocation circuit.

Such a configuration enables the line length of the CLK signal and the DATA signal to be made uniform even when there are two DATA signal channels, and a deviation in the timing of the CLK signal and the DATA signal can be suppressed. Furthermore, the shift registers of the HE generation circuit and the drive circuit operate according to the frequency-divided CLK signals, and, therefore, the timing of the CLK signal and the DATA signal includes a comparatively large temporal margin. Thus, since the CLK and DATA line lengths are not required to be strictly uniform, the shift registers can be disposed in the order of signal transmission.

The present invention is not limited to the configuration described in the above exemplary embodiments. For example, in addition to the circuits described above, the region 505B may include a voltage generation circuit or a test circuit for testing the operation of the recording element substrate. The voltage generation circuit generates a second voltage to be supplied to the voltage conversion circuit as described with reference to FIG. 3.

The HE generation circuit 504, for example, may include a circuit that divides one heater array into a plurality of blocks and generates a period signal for each block, in addition to a configuration in which a period signal is generated corresponding to the heater array.

The disposition of each circuit in the region 505A is not limited to that described in the first exemplary embodiment or the third exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-112368 filed May 14, 2010, which is hereby incorporated by reference herein in its entirety.

What is claimed is:

1. A substrate, comprising:

a first and a second element arrays in each of which a plurality of elements is arrayed along a first direction of the substrate;

a first and a second pad arrays in which a plurality of pads is arrayed along respective two opposite sides extending along a second direction of the substrate;

a reception circuit configured to receive low voltage differential signals for driving the elements;

a data generation circuit configured to generate data corresponding to the first and the second element arrays, respectively based on received data;

a signal generation circuit configured to generate a period signal for determining a drive period of the elements based on the generated data;

a confirmation circuit configured to confirm erroneous reception or transmission of data during a transfer; and an output circuit configured to output information related to the substrate, wherein the signal generation circuit, the reception circuit, and the data generation circuit are disposed in a first region between the first and second element arrays and the first pad array, and wherein the output circuit is disposed in a second region between the first and second element arrays and the second pad array.

2. The substrate according to claim 1, further comprising:

a first drive circuit configured to drive the elements contained in the first element array, wherein the first drive circuit and the first element array are disposed in the second direction.

3. The substrate according to claim 2, wherein the first drive circuit comprises:

a control circuit configured to output signals for driving, at different timing, elements belonging to each of a plurality of groups each including a predetermined number of adjacent elements in the first element array; and shift registers allocated to the respective groups, wherein the control circuit and the shift registers are arrayed along the first direction, and the control circuit is disposed closer to the second pad array than the shift registers.

4. The substrate according to claim 1, further comprising:

a plurality of temperature detection elements; and a selection circuit configured to select the temperature detection elements.

5. The substrate according to claim 1, further comprising:

a determination circuit configured to determine parity of data transferred in the substrate.

6. The substrate according to claim 1, wherein the reception circuit receives data transmitted by differential signaling.

7. The substrate according to claim 1, wherein the signal generation circuit, the reception circuit, and the data generation circuit are not disposed in the second region.

8. The substrate according to claim 1, wherein the output circuit is not disposed in the first regions.

9. A method comprising:

arraying a first and a second element arrays in each of which a plurality of elements along a first direction of a substrate;

arraying a first and a second pad arrays in which a plurality of pads along respective two opposite sides extending along a second direction of the substrate;

receiving low voltage differential signals for driving the elements;

generating data corresponding to the first and the second element arrays, respectively based on received data;

generating a period signal for determining a drive period of the elements based on the generated data;

confirming erroneous reception or transmission of data during a transfer;

outputting information related to the substrate;

disposing a signal generation circuit that generates the period signal for determining the drive period of the elements based on the generated data, a reception circuit that receives the low voltage differential signals for driving the elements, and a data generation circuit that generates the data corresponding to the first and the second element arrays, respectively based on the received data between the first and second element arrays and the first pad array; and disposing an output circuit outputting the information related to the substrate between the first and second element arrays and the second pad array.

10. The method according to claim 9, further comprising:

driving the elements contained in the first element array; and disposing a first drive circuit and the first element array in the second direction.

11. The method according to claim 10, further comprising:

outputting signals for driving, at different timing, elements belonging to each of a plurality of groups each including a predetermined number of adjacent elements in the first element array by a control circuit;

allocating shift registers to the respective groups;

arraying the control circuit and the shift registers along the first direction; and disposing the control circuit closer to the second pad array than the shift registers.

12. The method according to claim 9, further comprising selecting temperature detection elements.

13. The method according to claim 9, further comprising determining parity of data transferred in the substrate.

14. The method according to claim 9, further comprising receiving data transmitted by differential signaling.

15. A substrate, comprising:

an element array in which a plurality of elements is arrayed along a first direction of the substrate;

a first pad array in which a plurality of pads is arrayed extending along a second direction of the substrate;

a second pad array in which a plurality of pads is arrayed extending along the second direction of the substrate, the element array being disposed between the first pad array and the second pad array;

an output pad configured to output electrical signals from the substrate;

a reception circuit configured to receive low voltage differential signals for driving the elements;

a data generation circuit configured to generate data corresponding to the element array, based on received data which is received by the reception circuit;

a signal generation circuit configured to generate a period signal for determining a drive period of the elements based on generated data which is generated by the data generation circuit; and a determination circuit configured to determine parity to detect a transfer error for data transferred in the substrate, wherein the reception circuit, the data generation circuit, and the signal generation circuit are disposed in a first region between the element array and the first pad array; and an output circuit configured to output, to the output pad, information related to the substrate, the output circuit being disposed in a second region between the element array and the second pad array.

16. The substrate according to claim 15, wherein the element array includes a first element array and a second element array.

17. The substrate according to claim 16, wherein the drive circuit comprises:

a control circuit configured to output signals for driving, at different timing, elements belonging to each of a plurality of groups each including a predetermined number of adjacent elements in the element array; and shift registers allocated to the respective groups, wherein the control circuit and the shift registers are arrayed along the first direction, and the control circuit is disposed closer to the second pad array than the shift registers.

18. The substrate according to claim 15, further comprising:

a drive circuit configured to drive the elements contained in the element array, wherein the drive circuit and the element array are disposed in the second direction.

19. The substrate according to claim 15, further comprising:

a plurality of temperature detection elements; and a selection circuit configured to select the temperature detection elements.

20. The substrate according to claim 15, wherein the determination circuit further determines parity to detect a reception error for data received outside of the substrate.

21. The substrate according to claim 15, wherein the reception circuit receives data transmitted by differential signaling.

22. The substrate according to claim 15, wherein the output pad is included in the second pad array.

* * * * *